United States Patent [19]

Holt

[11] Patent Number: 5,009,180

[45] Date of Patent: Apr. 23, 1991

[54] HULL HOLE CLOSURE FOR AN OIL TANKER

[76] Inventor: William T. Holt, 4610 Ellendale Rd., Memphis, Tenn. 38135

[21] Appl. No.: 579,365

[22] Filed: Sep. 7, 1990

[51] Int. Cl.[5] ..... B63B 43/16

[52] U.S. Cl. ..... 114/229; 114/227

[58] Field of Search ..... 114/227-229; 220/232; 405/12

[56] References Cited

U.S. PATENT DOCUMENTS

| | | | |
|---|---|---|---|
| 136,817 | 3/1973 | Cooper | 114/227 |
| 373,133 | 11/1987 | Duncan | 114/227 |
| 1,221,496 | 4/1917 | Wullyamoz et al. | 114/227 |
| 1,306,938 | 6/1919 | Achiha | 114/227 |
| 2,127,871 | 8/1938 | Kozloff | 114/227 |
| 3,400,684 | 9/1968 | Gerardi | 114/229 |
| 3,669,055 | 6/1972 | Buce | 114/229 |
| 4,026,233 | 5/1977 | Cox | 114/229 |
| 4,161,155 | 7/1979 | Cloutier | 114/227 |
| 4,569,303 | 2/1986 | McDuff et al. | 114/229 |
| 4,712,502 | 12/1987 | McDuff et al. | 114/229 |

*Primary Examiner*—Ed Swinehart

*Attorney, Agent, or Firm*—Walker & McKenzie

[57] ABSTRACT

A hull hole closure apparatus for use with an oil tanker having a hull hole, to seal the hull hole. A first embodiment of the hull hole closure consists of a flexible, waterproof, rectangular sheet, having forward and aft longitudinal reinforcing straps on its concave side edges, as well as transverse reinforcing straps on the concave top edges, joined at the corners with reinforced corner pieces. The hull hole closure is symmetrical about the keel of the tanker, passing under the keel from the starboard to the port side. Cables, secured to winches or cleats, attach to corners of the hull hole closure, drawing it tightly against the hull. Inflatable forward and aft longitudinal high pressure sealing hoses attached to the inner surface of the sheet, adjacent the side edges, seal the sheet to the hull and keel, while longitudinal inflatable bladders extend outward past the high pressure sealing hoses to fill irregular concave areas in the hull not in contact with the high pressure sealing hoses. Transverse inflatable bladders on the upper portions of the sheet seal the top edges to the hull, preventing oil from washing into the sea. Flaps, secured together by tape or a cable, entrap the longitudinal inflatable bladders in a compacted position until inflation. A second embodiment passes around the bow and under the keel, and has a flap which hooks over the bow. This second embodiment has only aft longitudinal straps and hoses, omitting the forward straps and hoses.

23 Claims, 6 Drawing Sheets

HULL HOLE CLOSURE FOR AN OIL TANKER

BACKGROUND OF THE INVENTION

1. Field of the Invention

The present invention relates, in general, to devices for the temporary repair of leaks in the hulls of ships, and in particular, to a hull hole closure for use with an oil tanker which extends from one side of the tanker to the other, passing under the keel, keeps oil from escaping from the damaged hull, and prevents sea water from passing into the hull and sinking the ship.

2. Information Disclosure Statement

A preliminary patentability search in class 114, subclasses 227, 228, and 229, produced the following patents: Cooper, U.S. Pat. No. 136,817, issued Mar. 18, 1873; Duncan, U.S. Pat. No. 373,133, issued Nov. 15, 1887; Wullyamoz et al., U.S. Pat. No. 1,221,496, issued Apr. 3, 1917; Achiha, U.S. Pat. No. 1,306,938, issued June 17, 1919; U.S. Pat. No. 2,127,871, issued Aug. 23, 1938; Gerardi, U.S Pat. No. 3,400,684, issued Sept. 10, 1968; Buce, U.S. Pat. No. 3,669,055, issued June 13, 1972; Cox, U.S. Pat. No. 4,026,233, issued May 31, 1977; Cloutier, U.S. Pat. No. 4,161,155, issued July 17, 1979; and McDuff et al., U.S. Pat. No. 4,712,502, issued Dec. 15, 1987. While each of the above patents disclose various apparatus for repair of leaks in the hulls of ships, none disclose or suggest the present invention. More specifically, none of the above patents disclose or suggest a hull hole closure, for use with an oil tanker having a hull hole, comprising a flexible, substantially waterproof sheet for covering the hull hole, said sheet for extending under the keel of the tanker from the port side to the starboard side of the tanker, and further comprising inflatable seals on each edge and upper portion of the sheet.

Duncan, U.S. Pat. No. 373,133, Gerardi, U.S. Pat. No. 3,400,684, and Cox, U.S. Pat. No. 4,026,233, describe various hull covers for repairing ship hulls which extend under the keel and around the bow. None of these patents deal with the specific problems of oil tankers, or describe or disclose seals at the edges and upper portion of the hull cover; unlike the present invention, the hull covers of these patents would thus allow oil to escape over the top of the cover in high seas as waves wash oil from the hull. Also, the present invention, having seals at the edges of the hull hole closure, provides a better seal between the sheet and the hull, thus containing the oil within the vessel more completely than would such a cover lacking such seals.

Many prior patents have attempted to solve the problem of covering hull holes by means of localized patches, held in place over the hole by ropes or cables. Cooper, U.S. Pat. No. 136,817, describes an inflatable air-tight bag held in place over the hole by cables extending up to the deck on either side of the ship. Achiha, U.S. Pat. No. 1,306,938, similarly describes an inflatable mat which is held in position over the hull hole by similar cables. The apparatuses of both of these patents, in contrast to the present invention, are difficult to maneuver and position precisely over the hull hole, since they do not extend under the keel of the ship. Also, since they only cover a localized area around the hole, will have a tendency to be pushed upward by the buoyancy of the patch by the water, a problem avoided by the present invention which, having substantially symmetric portions on either side of the keel, would not tend to be dislocated from the hull hole by the force of the surrounding water. Buce, U.S. Pat. No. 3,669,055, describes a compartmentalized patch having an outer cover with compartmentalized passageways that similarly would be difficult to position over the hull hole and which would have a tendency to be pushed out of position by the surrounding seas, once inflated. Similarly, McDuff et al., U.S. Pat. No. 4,712,502, describes a localized patch with inflatable seals around its periphery, held in place by ropes or cables, equally difficult to position and remain over the hull hole.

Wullyamoz et al., U.S. Pat. No. 1,221,496, describes a curtain-like patch of tarred cloth which is unrolled from a roller supported by a pneumatic frame. The present invention has no such frame, and extends under the keel of the ship. Kozloff, U.S. Pat. No. 2,127,871, describes a variety of hull patching devices, including a fabric patch with a plurality of rubber pads on the inner surface. Unlike the present invention, the apparatus of the Kozloff patent does not have inflatable seals on the edges, and is localized, not extending below the keel, thus increasing the difficulty in positioning the patch over the hull hole.

Cloutier, U.S. Pat. No. 4,161,155, describes a frame and wire net used to secure an inflatable bladder and foam layer against the hull, again in a localized patch. The present invention requires no such frame or wire net.

SUMMARY OF THE INVENTION

Environmental hazards due to leaks from loaded oil tankers whose hulls have become damaged or ruptured have generated increasing public and commercial attention. Not only is it desirable to provide a hull repair device which prevents the loss and sinking of the oil tanker itself, but also to provide a hull repair device which prevents, to the extent possible, the discharge of oil into the sea while the tanker is being unloaded or while it steams to a port for unloading or repair.

It is an object of the present invention to provide a hull hole closure device which may be easily installed and positioned over the hull hole, which will not tend to be dislodged from that position by the force of the surrounding seas, and which will substantially seal the oil cargo from escape into the sea, while also preventing the influx of water into the cargo hold.

It is a further object of the present invention to provide a hull hole closure seal which is effective on vessels having concave or irregularly shaped hulls which might not otherwise be receptive to patching.

DESCRIPTION OF THE PREFERRED EMBODIMENT

Figure 1:
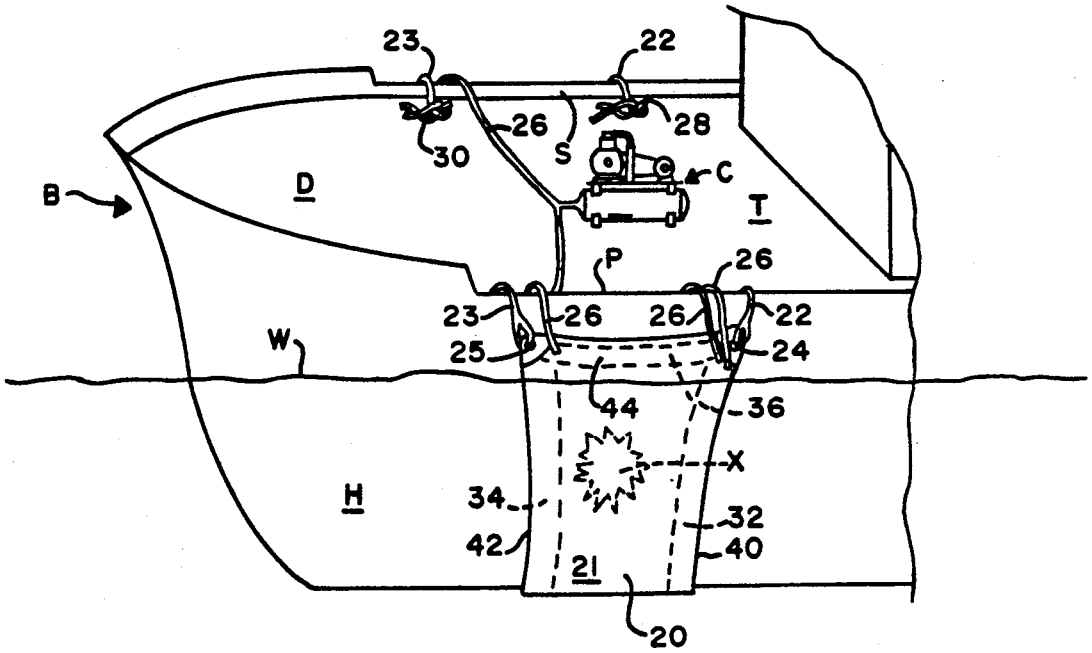
FIG. 1 is a view of a first embodiment of the present invention, shown installed on a side portion of an oil tanker.

Referring to FIG. 1, the hull hole closure 20 is shown in use on an oil tanker T, secured by securing means to the hull of tanker T, and extending under the keel from the port side P of tanker T to starboard side S. Hull hole closure 20 is shown covering hull hole X in the hull H of the tanker, said hole X being shown for reference purposes on port side P of tanker T. As shown, the securing means for hull hole closure 20 may be ropes or cables 22 and 23 fastened to eyelets 24 and 25 on one end, and attached to cleats, such as cleats 28 and 30 located on the deck D of tanker T, or to a winch, not shown, in the well known manner, at the other end. Additional ropes or cables may be provided, in a manner that will be apparent to those skilled in the art, attached to other eyelets, not shown, located along the edge of hull hole closure 20.

Hull hole closure 20 is seen to comprise a flexible, substantially waterproof sheet 21, having an aft edge 40 and a forward edge 42, each extending from port side P to starboard side. S Sheet 21 also comprises a port upper portion 44, located substantially above the water line W of tanker T, and a starboard upper portion (not shown), similarly located substantially above water line W on starboard side S of tanker T.

Hull hole closure 20 is also seen to comprise a port upper belt 36, attached to port upper portion 44, and a similar starboard upper belt 38 attached to the starboard upper portion 46. Similarly, hull hole closure 20 also comprises forward and aft belts 34 and 32, respectively, attached to sheet 21 substantially adjacent the forward edge 42 and aft edge 40, extending from port side P to starboard side S.

Figure 2:
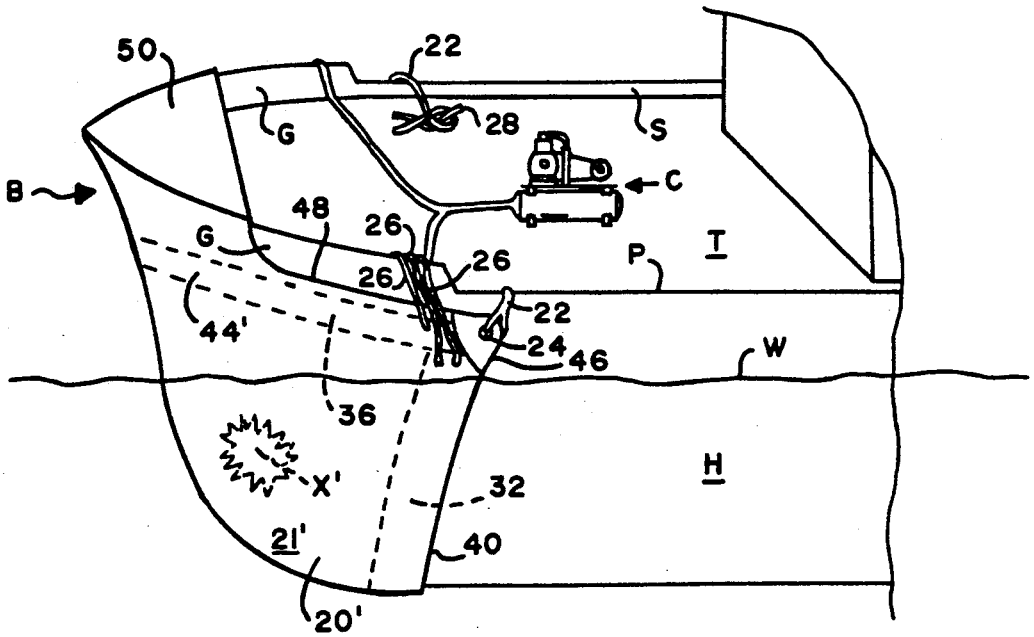
FIG. 2 is a view of a second embodiment of the present invention, shown installed on the bow portion of an oil tanker.

FIG. 2 shows a variation of the present invention, for use with hull holes in the forward region of tanker T, such as the region around the bow B. Hull hole closure 20′ is seen extending around the bow B and under the keel to cover bow hole X′ in hull H. Hull hole closure 20′, in a manner similar to closure 20 in FIG. 1, comprises a flexible, substantially waterproof sheet 21′ having an aft edge 40 extending from port side P to starboard side S of hull H, and an upper portion 44′, located substantially above the water line W, extending substantially from the end of aft edge 40 on the port side to the end (not shown) of aft edge 40 on the starboard side. Aft belt 32 is attached to sheet 21′ as shown, substantially adjacent aft edge 40, extending from port side P to starboard side S; similarly, upper belt 36 is attached to upper portion 44′, extending around the bow B as shown. Hull hole closure 20′ is attached to hull H by securing means, such as ropes or cables 22 attached to cleats 28 and aft eyelets 24, as well as bow flap 50, extending over gunwales G of tanker T and across bow B, which secures hole closure 20′ to the bow B, as will now be apparent. Optionally, bow flap 50 may be omitted, and securing ropes or cables may be attached from additional cleats (not shown) located in the bow B of tanker T to eyelets (not shown) along upper edge 48 of sheet 21′, in a manner well known to those skilled in the art.

Figure 3:
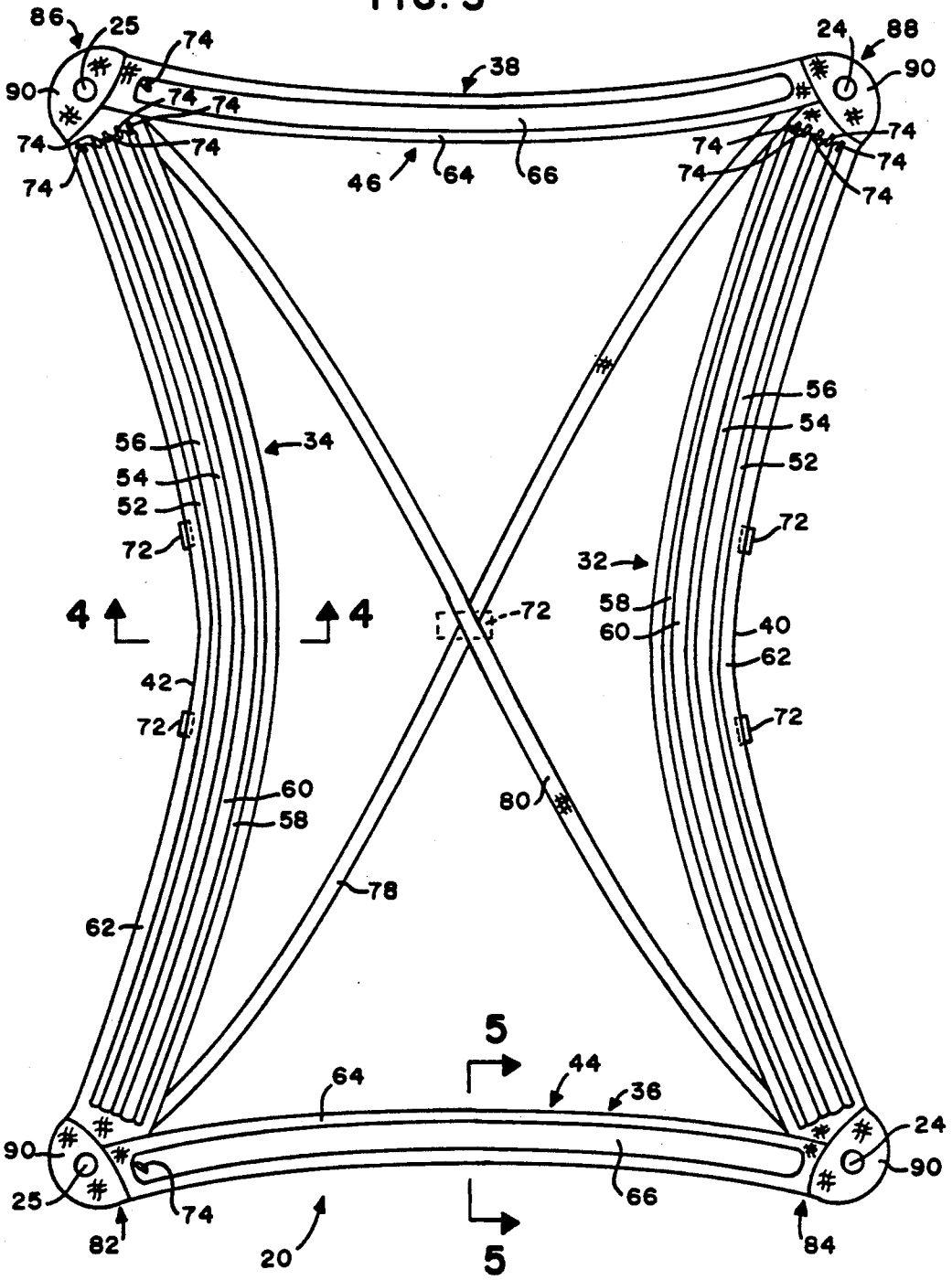
FIG. 3 is a plan view of the first embodiment of the present invention shown in FIG. 1.

Referring to FIG. 3, a plan view of the inner surface of the hull hole closure shown in FIG. 1 is shown. As in FIG. 1, hull hole closure 20 is seen to comprise a forward belt 34 and an aft belt 32, each said forward and aft belt comprising a longitudinal reinforcing strap 62, attached to sheet 21, and extending from the port upper portion 44 to the starboard upper portion 46 of sheet 21, substantially along forward and aft edges 42 and 40 of sheet 21, as shown. Sheet 21 is chosen to be of a suitable flexible, substantially waterproof material, such as vinyl or waterproof canvas, well known to those skilled in the art, which will conform to the contours of hull H of tanker T, and substantially inhibit the passage of water and oil. Hull hole closure 20 also comprises a port upper belt 36 and a starboard upper belt 38, each said upper belt comprising a transverse reinforcing strap 64 attached to the port and starboard upper portions 44 and 46, respectively, of sheet 21. Longitudinal reinforcing straps 62 and transverse reinforcing straps 64, preferably of nylon or other suitable material, meet in port forward corner 82, port aft corner 84, starboard forward corner 86, and starboard aft corner 88 of sheet 2I, each said corner preferably reinforced by corner reinforcements 90, also preferably of nylon, and each said corner comprising means for attaching hull hole closure 20 to the hull of the tanker, such as reinforced eyelets 24 and 25. Straps 62 and 64 are attached, in a manner well known to those skilled in the art, such as by sewing or the use of a suitable adhesive, to the inner surface 68 of sheet 21, as shown in FIG. 4 and 5, which is placed adjacent the hull of the tanker, or to the outer surface 70 of sheet 21, as desired.

Figure 4:
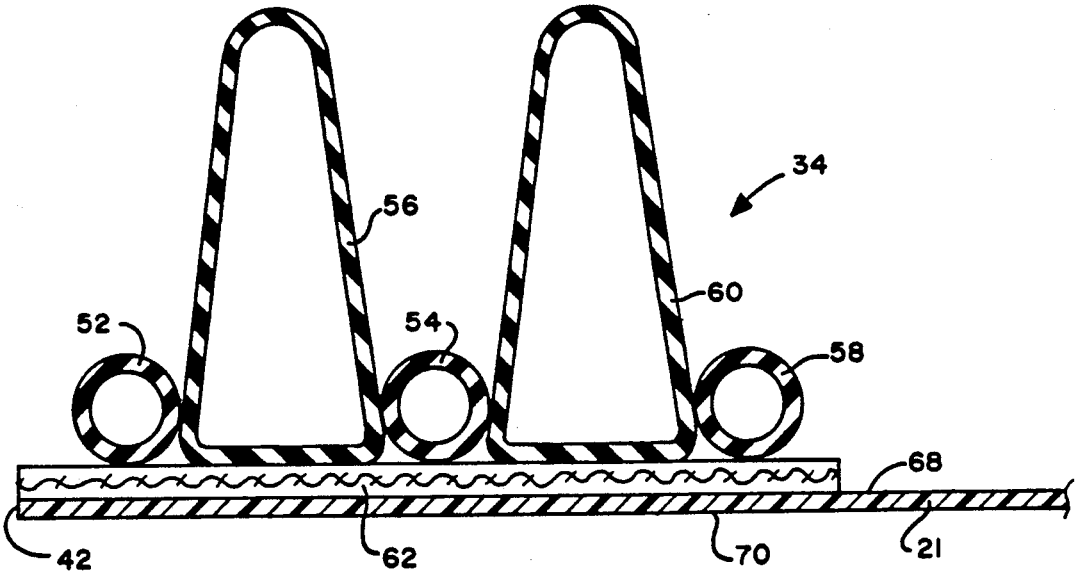
FIG. 4 is a partial section of a lateral edge of the invention, taken along the lines 4—4 shown in FIG. 3, showing a portion of the lateral seals and longitudinal belt.
Figure 5:
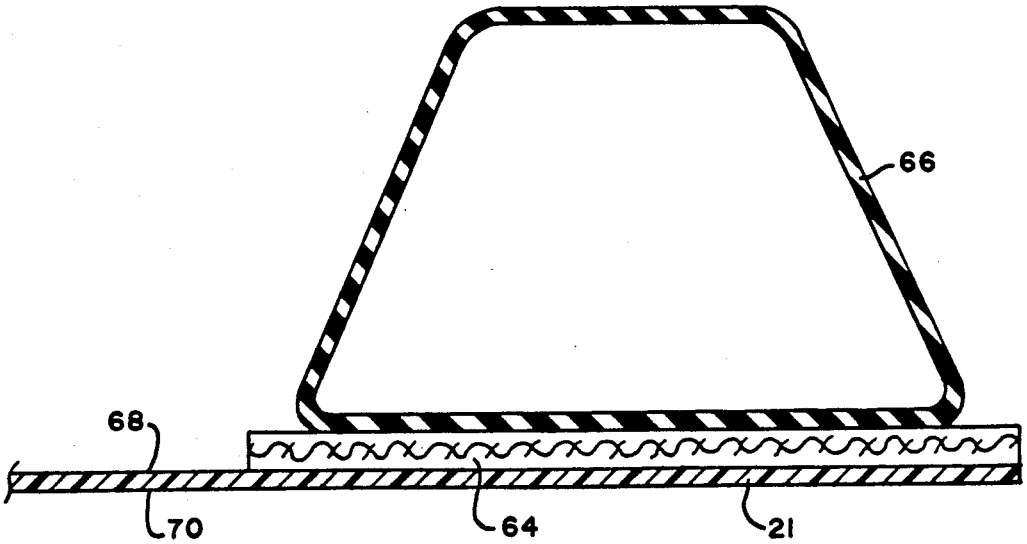
FIG. 5 is another partial section of an upper edge of the invention, taken along the lines 5—5 shown in FIG. 3, showing a portion of the upper seal and transverse belt.

Referring to FIG. 3 and FIG. 4, forward belt 34 is seen to additionally comprise a first longitudinal high pressure hose 52 which is flexible and hollow, and which may be expandibly inflated by high pressures of fluids, preferably fluids lighter than water such as air, introduced through valves or inlets 74, which are connected through hoses 26 as shown in FIG. 1, to pump or compressor C located on tanker T. First longitudinal high pressure hose 52, located on the inner surface 68 of sheet 21 substantially parallel to longitudinal reinforcing strap 62, will, when inflated, seal the forward and aft edges of sheet 2I to the hull of the tanker in a manner that will be hereinafter described.

Additionally, forward belt 34 may comprise a second longitudinal high pressure hose 54, substantially similar to first longitudinal high pressure hose 52 and spaced apart from first longitudinal high pressure hose 52, and a first longitudinal inflatable bladder 56, located between the first and second longitudinal high pressure hoses 52 and 54. First longitudinal inflatable bladder 56 is understood to be flexible and hollow, for inflation at a lower pressure of fluid, preferably a fluid lighter than water such as air, introduced through valves or inlets 74, than the fluid pressure used in the longitudinal high pressure hoses, 52, 54, and 58 (hereinafter described); the actual pressure chosen may vary with the particular application, and should be appropriately chosen to maintain a substantial seal between the bladder and the hull, as will now be apparent to those skilled in the art. Second longitudinal high pressure hose 54 provides additional sealing of sheet 21 to the hull of the tanker, while first longitudinal inflatable bladder 56 aids in sealing irregular contours in the hull in a manner that will be hereinafter described. For improved sealing, forward belt 34 may also comprise a third longitudinal high pressure hose 58, substantially similar to first and second longitudinal high pressure hoses 52 and 54, respectively, as well as a second longitudinal inflatable bladder 60, substantially similar to first longitudinal inflatable bladder 56. Hoses 52, 54, 58, and bladders 56 and 60 are preferably fixedly attached to reinforcing strap 62 by suitable means now known to those skilled in the art.

Aft belt 32 is substantially similar to forward belt 34, but being attached to aft edge 40 of sheet 21 rather than forward edge 42, as is forward belt 34.

Referring to FIG. 3 and FIG. 5, port upper belt 36 is seen to also comprise a transverse inflatable bladder 66 fixedly attached to strap 64, similar in nature to longitudinal inflatable bladders 56 and 60, but preferably wider in cross-sectional dimension. Transverse inflatable bladder 66, when inflated, provides a seal between the upper edge of sheet 2I and hull H of the tanker, thus containing oil that would otherwise be swept into the sea by high waves washing over the top edges of hull hole closure 20. Transverse inflatable bladder 66 may be inflated through valve or inlet 74 by fluids, preferably fluids lighter than water such as air, which come through hoses 26 from pump or compressor C shown in FIG. 1 and 2, in a manner similar to the inflation of longitudinal inflatable bladders 56 and 60, as will b hereinafter described.

For additional strength, hull hole closure 20 preferably comprises diagonal reinforcing straps, such as first and second diagonal reinforcing straps 78 and 80, respectively, shown in FIG. 3, extending from port forward corner 82 to starboard aft corner 88, and from port aft corner 84 to starboard forward corner 86, respectively. Straps 78 and 80, like the transverse and longitudinal reinforcing straps 64 and 62, are attached to the inner or outer surface of sheet 21, such as by sewing or the use of a suitable adhesive, in a manner well known to those skilled in the art, and are also similarly attached to corner reinforcements 90. Straps 78 and 80, also like straps 64 and 62, are preferably of nylon or other suitable material. These diagonal reinforcing straps 78 and 80 provide additional strength and securing tension to the hull hole closure as it is tightened against the hull, in a manner hereinafter described.

Figure 6:
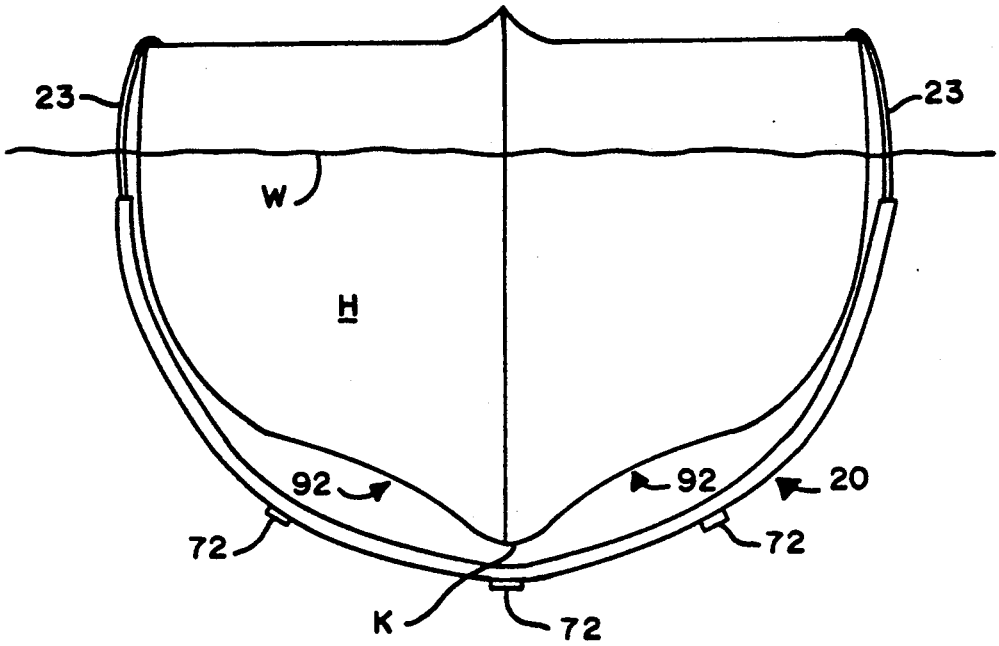
FIG. 6 is a section of a tanker across the beam thereof, showing the present invention being installed.
Figure 7:
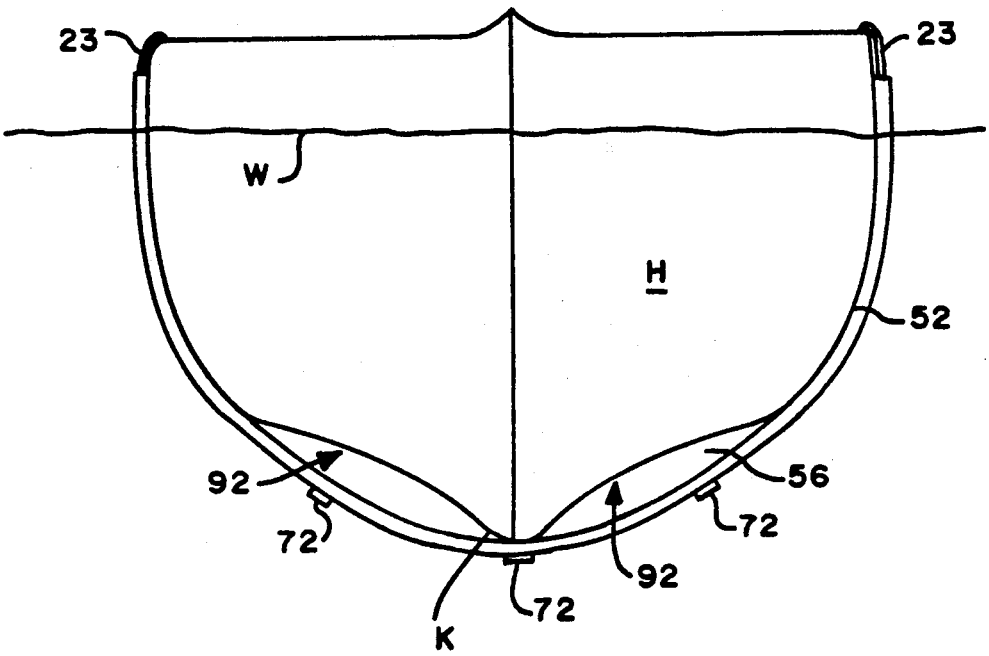
FIG. 7 is a similar section of a tanker across the beam thereof, showing the present invention positioned, secured, and installed.

Installation of the hull hole closure 20 is relatively straightforward. The apparatus, with ropes or cables 22 and 23 attached, is cast over the bow of the damaged tanker, and maneuvered adjacent the hole in the hull. As shown in FIG. 3 and FIG. 6, weights 72 may be attached to hull hole closure 20 for spacing the hull hole closure from the hull during installation, causing the hull hole closure to sink into the water, and thus, away from the hull. Next, the hull hole closure 20 is secured tightly to the hull by tightening ropes or cables 22, 23 manually or by the use of winches, in a manner well known to those skilled in the art. It should be noted that the edges of sheet 21 are substantially concave in shape, as shown in FIG. 1, 2, and 3, allowing a tighter seal to be formed between the sides of sheet 21 and hull H of the tanker when the corners of hull hole closure 20 are tightened in the aforementioned manner, as will now be understood by those skilled in the art.

With hull hole closure 20 secured to the hull, longitudinal high pressure hoses 52, 54, and 58 are now inflated through valves or inlets 74 attached through hoses 26 to compressor or pump C. Longitudinal high pressure hoses 52, 54, and 58, located on the inner surface of sheet 2I, substantially seal sheet 21 to the hull around the sides of the hull and under the keel. However, some tankers may have irregularly shaped portions of the hull, such as concave regions 92 as shown in FIG. 6, that do not come in contact with portions of sheet 21 and high pressure hoses 52, 54, and 58, when it has been secured tightly to the hull in the manner previously described. To seal these concave portions of the hull, inflatable bladders, such as longitudinal in flatable bladders 56 and 60, previously described, may be additionally provided, attached to the inner surface of sheet 21.

High pressure hoses 52, 54, and 58, when inflated, cause sheet 21 to be spaced a slight distance from hull H in a manner that will now be apparent. This slight spacing allows longitudinal inflatable bladders 56 and 670 to now be inflated without collapse. It should be noted that inflatable bladders 56 and 60 are preferably trapezoidal in shape, as shown in FIG. 4, providing support and stability for the bladders as they inflate and remain inflated, and that, when inflated with appropriate pressure, bladders 56 and 60 extend substantially beyond high pressure hoses 52, 54, and 58, allowing a seal to be formed against concave regions 92 by the longitudinal inflatable bladders, as shown in FIG. 6.

Finally, transverse inflatable bladders 66 re inflated, completing the seal between the hull hole closure 20 and hull H. It should be noted that, as shown in FIG. 5, transverse inflatable bladder 66 is also trapezoidal in shape, again to provide support and stability for the bladder as it inflated and remains inflated.

It should be pointed out that the integrity of the lateral seals formed by the longitudinal high pressure hoses and longitudinal inflatable bladders is maintained not only by the fluid pressure within those hoses and bladders, opposing the tension exerted on corner eyelets 24 and 25 by ropes or cables 22 and 23, but also by the water pressure of the sea, forcing the hoses, bladders, and flexible sheet 21 against the hull of the tanker.

It will also be apparent to those skilled in the art that since the present invention passes under the keel from the port side to the starboard side, the precise positioning of the hull hole closure over the hull hole is not as critical as that required for a localized patch covering only the hole itself. Also, due to the substantially symmetrical nature of the design of the present invention, being placed on both sides of the tanker, with the middle of the hull hole closure substantially aligned with the keel of the tanker, the pressure of the sea, exerted against the hull hole closure during inflation and after full inflation, will not tend to dislodge the apparatus from its position over the hole.

If desired, longitudinal inflatable bladders 56 and 60 may be constructed as a series of separately inflatable compartments, partitioned from one another, placed end to end over the length of the forward and aft belts. In this manner, if the chosen inflation fluid has a buoyancy which is lighter than the surrounding seawater, the fluid, such as air, will be properly contained in the compartment, providing better sealing for the portions of the hull hole closure remote from the surface of the water.

The second embodiment of the present invention, previously described and shown in FIG. 2, is installed in a procedure similar to that used and described above for the first embodiment, in a manner now understood by those skilled in the art.

Figure 8:
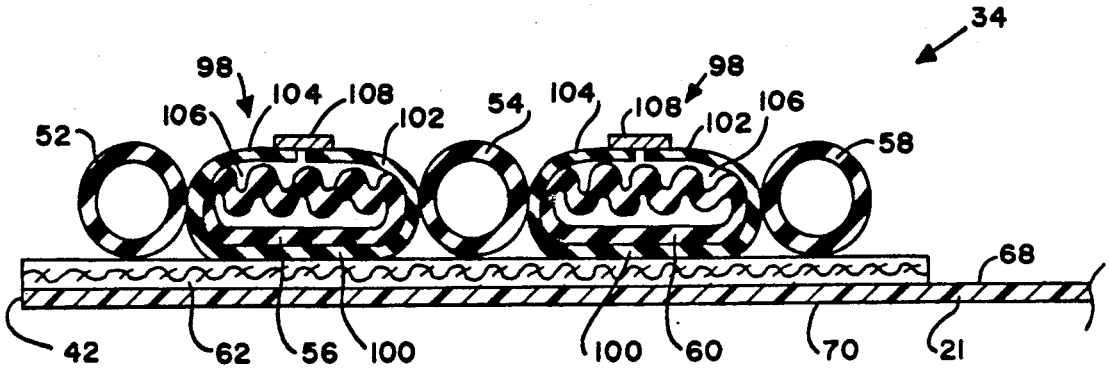
FIG. 8 is a partial section of a lateral edge of the invention, taken along the lines 8—8 shown in FIG. 10, showing a variation of a portion of the lateral seals and longitudinal belt, before inflation of the longitudinal bladders.
Figure 9:
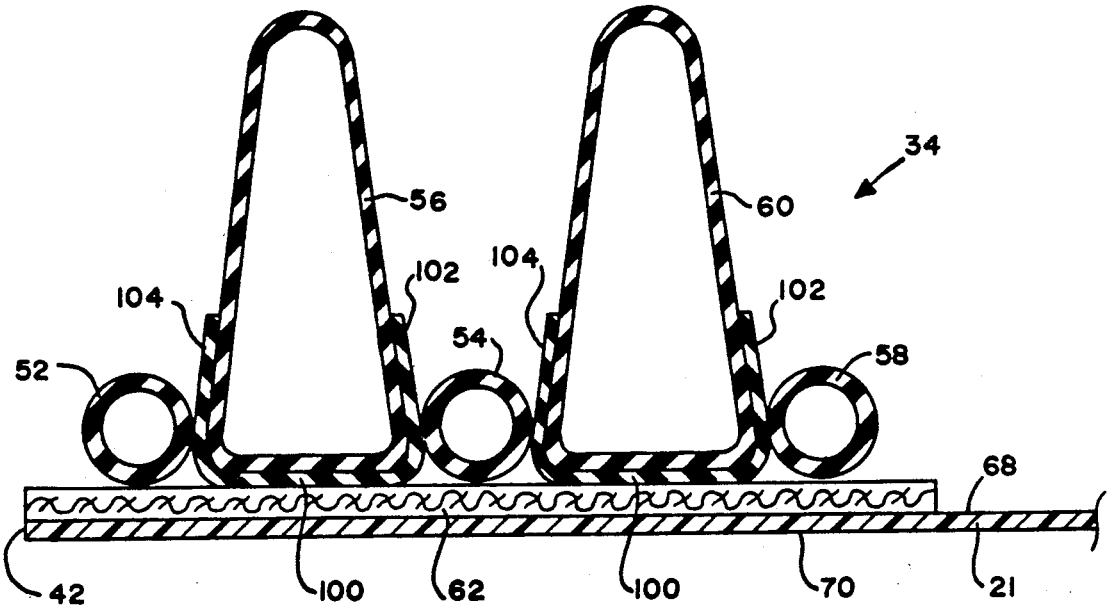
FIG. 9 is a similar partial section as in FIG. 8, but with the longitudinal bladders shown inflated.
Figure 10:
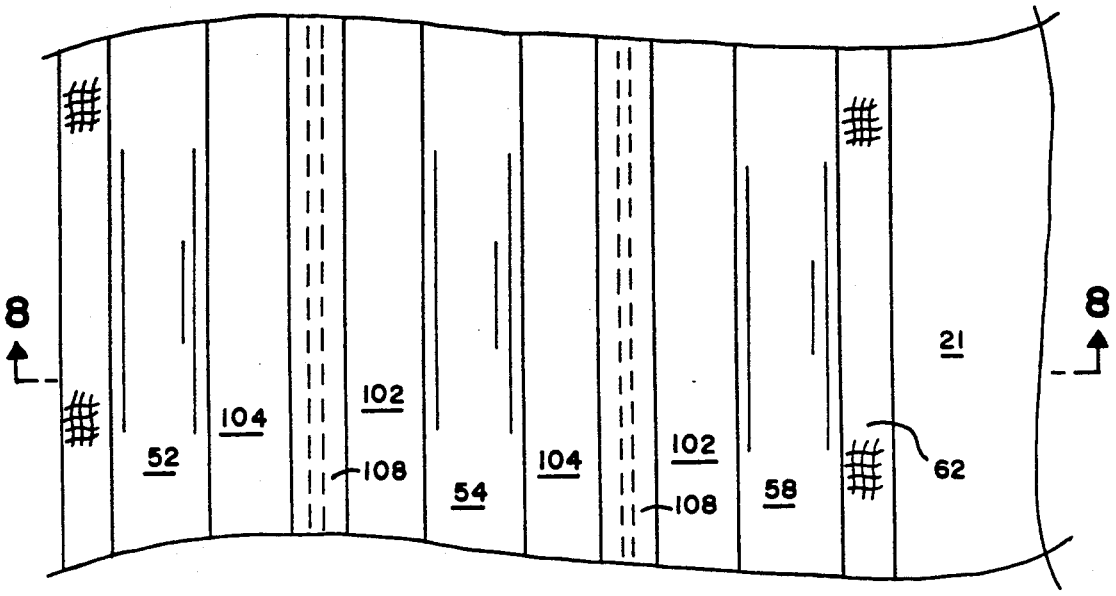
FIG. 10 is a plan view of a portion of a lateral edge of a variation of the invention, showing the break tape and flaps which secure the uninflated longitudinal bladders.
Figure 11:
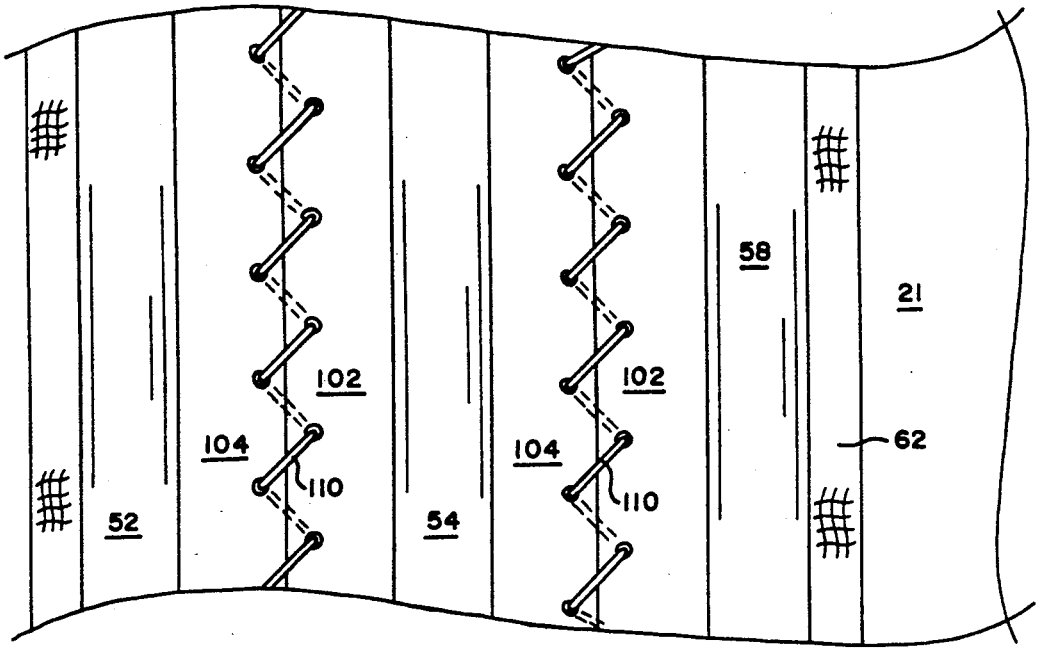
FIG. 11 is a also a plan view of a portion of a lateral edge of another variation of the invention, similar to FIG. 10, in which a draw string or cable replaces the break tape.

FIG. 8, 9, 10, and 11 show a variation of the present invention in which the forward and aft belts additionally comprise securing means 98 which retain the inflatable bladders 56 and 60 in a compacted position during the positioning of the hull hole closure over the hull hole, and during inflation of high pressure hoses 52, 54, and 58, so that bladders 56 and 60, when uninflated, do not become caught or pinched between high pressure hoses 52, 54, or 58 and the hull. Securing means 98 preferably comprises sheath 100 having a first flap 102 and a second flap 104 positioned for entrapment within compartment 106 formed by flaps 102 and 104. Securing means 98 additionally comprises means for securing first flap 102 to second flap 104 in a manner which entraps bladder 56 or 60 in the aforementioned compacted position. The means for securing the first flap to the second flap may be a length of break tape 108, as shown in FIG. 8 and 10, or, possibly a cable or raw string 110 sewing first flap 102 to second flap 104 as shown in FIG. 11. It will now be apparent to those skilled in the art that securing means 98 thus retains bladder 56 or 60 in a compacted position while the bladders remain uninflated.

When bladders 56 and 60 are inflated to seal the hull to the hull hole closure and fill irregular and concave regions of the hull as previously described, tape 108 will be forced to break loose by the force of bladder 56 or 60 within compartment 106. Alternatively, cable or draw string 110, preferably nylon string or steel cord, sewing first flap 102 to second flap 104, could be withdrawn manually or by a winch, unsecuring flap 102 form flap 104, after proper positioning of the hull hole closure and in preparation for inflation of bladders 56 and 60, in a manner that will now be apparent to those skilled in the art. It should be recognized that there are many variations for securing means 98 and the means for securing first flap 10 92 to 104.

Although the present invention has been described and illustrated with respect to a preferred embodiment and a preferred use therefor, it is not to be so limited since modifications and changes can be made therein which are within the full intended scope of the invention.

I claim:

1. A hull hole closure, for use with an oil tanker having a hull hole, said closure comprising:

a. a flexible, substantially waterproof sheet for covering said hull hole and for extending under the keel of the tanker from the port side to the starboard side of the tanker, said sheet comprising:

i. a forward edge and an aft edge, for location toward the bow and stern, respectively, of the tanker;

ii. a port upper portion and a starboard upper portion, for location substantially above the water line on the port side and the starboard side, respectively, of the tanker;

iii. an inner surface for placement substantially adjacent the hull of the tanker; and, iv. an outer surface of the placement away from the hull of the tanker;

b. a forward belt and an aft belt, attached to the sheet substantially adjacent the forward edge and the aft edge, respectively, of the sheet, each said forward and aft belt extending from the port upper portion to the starboard upper portion of the sheet, each said forward and aft belt comprising:

i. a longitudinal reinforcing strap attached to the sheet; and ii. a first longitudinal high pressure hose for inflation, located substantially parallel to the longitudinal reinforcing strap, and attached to the longitudinal reinforcing strap on the inner surface of the sheet;

c. a starboard upper belt and a port upper belt, attached to the starboard and port upper portions, respectively, of the sheet, each said upper belt comprising:

i. a transverse reinforcing strap attached to the sheet, and ii. a transverse inflatable bladder attached to the upper belt on the inner surface of the sheet for inflation to substantially seal the upper portion of the sheet to the hull; and d. means for securing the hull hole closure to the tanker.

2. The hull hole closure as recited in claim 1, wherein said forward belt and said aft belt each further comprises:

a. a second longitudinal high pressure hose for inflation, spaced apart from the first longitudinal high pressure hose, located substantially parallel to the longitudinal reinforcing strap, and attached to the longitudinal reinforcing strap on the inner surface of the sheet; and b. a first longitudinal inflatable bladder attached to the longitudinal reinforcing strap and located between the first and second high pressure hoses, for inflation to substantially seal the respective edges of the sheet to the hull.

3. The hull hole closure as recited in claim 2, wherein said forward belt and said aft belt each further comprises securing means for securing the first longitudinal inflatable bladder in a compacted position while said first longitudinal inflatable bladder is uninflated.

4. The hull hole closure as recited in claim 3, wherein said securing means comprises a first flap and a second flap positioned for entrapment of the first longitudinal inflatable bladder in a compacted position, and means for securing the first flap to the second flap in a manner which entraps the first longitudinal inflatable bladder in said compacted position.

5. The hull hole closure as recited in claim 4, wherein the means for securing the first flap to the second flap is a length of tape.

6. The hull hole closure as recited in claim 4, wherein the means for securing the first flap to the second flap is a cable sewing the first flap to the second flap, said cable being adapted of removal prior to inflation of the first longitudinal inflatable bladder.

7. The hull hole closure as recited in claim 2, wherein said forward belt and said aft belt each further comprises:

a. a third longitudinal high pressure hose for inflation, spaced apart from the second longitudinal high pressure hose, remote from the first longitudinal high pressure hose, located substantially parallel to the longitudinal reinforcing strap, and attached to the longitudinal reinforcing strap on the inner surface of the sheet;

b. a second longitudinal inflatable bladder attached to the longitudinal reinforcing strap and located between the second and third high pressure hoses, for inflation to substantially seal the respective edges of the sheet to the hull; and, c. first and second securing means for respectively securing the first and second longitudinal inflatable bladders in a compacted position while said first and second longitudinal inflatable bladders are uninflated, said first and second securing means each respectively comprising:

i. a first flap and a second flap positioned for entrapment of each said respective longitudinal inflatable bladder in a compacted position, and ii. means for securing the first flap to the second flap in a manner which entraps each said respective longitudinal inflatable bladder in said compact position.

8. The hull hole closure as recited in claim 7, wherein the means for securing the first flap to the second flap is a length of tape.

9. The hull hole closure as recited in claim 7, wherein the means for securing the first flap to the second flap is a cable sewing the first flap to the second flap, said cable being adapted for removal prior to inflation of each said respective longitudinal inflatable bladder.

10. The hull hole closure as recited in claim 1, wherein the hull hole closure additionally comprises a weight attached to the hull hole closure for spacing the hull hole closure from the hull during installation of the hull hole closure.

11. The hull hole closure as recited in claim 10, wherein the forward edge and the aft edge of the sheet are each concave, and wherein the sheet additionally comprises:

a. a port forward corner substantially adjacent the port upper portion and the forward edge;

b. a port aft corner substantially adjacent the port upper portion and the aft edge;

c. a starboard forward corner substantially adjacent the starboard upper portion and the forward edge;

d. a starboard aft corner substantially adjacent the starboard upper portion and the aft edge;

e. a first diagonal reinforcing strap extending from the port forward corner to the starboard aft corner, and f. a second diagonal reinforcing strap extending from the starboard forward corner to the port aft corner.

12. In combination with a oil tanker having a hull hole, a hull hole closure comprising:

a. a flexible, substantially waterproof sheet covering said hull hole and extending under the keel of the tanker from the port side to the starboard side of the tanker, said sheet comprising:

i. a forward edge and an aft edge, located toward the bow and stern, respectively, of the tanker;

ii. a port upper portion and a starboard upper portion, located substantially above the water line on the port side and the starboard side, respectively, of the tanker;

iii. an inner surface substantially adjacent the hull of the tanker; and, iv. an outer surface away from the hull of the tanker;

b. a forward belt and an aft belt, attached to the sheet substantially adjacent the forward edge and the aft edge, respectively, of the sheet, each said forward and aft belt extending from the port upper portion to the starboard upper portion of the sheet, each said forward and aft belt comprising:

i. a longitudinal reinforcing strap attached to the sheet;

ii. a first longitudinal high pressure hose for inflation, located substantially parallel to the longitudinal reinforcing strap, and attached to the longitudinal reinforcing strap on the inner surface of the sheet;

c. a starboard upper belt and a port upper belt, attached to the starboard and port upper portions, respectively, of the sheet, each said upper belt comprising:

i. a transverse reinforcing strap attached to the sheet; and ii. a transverse inflatable bladder attached to the upper belt on the inner surface of the sheet for inflation to substantially seal the upper portion of the sheet to the hull; and, d. means for securing the hull hole closure to the tanker.

13. A hull hole closure, for use with an oil tanker having a hull hole, said closure comprising:

a. a flexible, substantially waterproof sheet, shaped substantially similar to the bow of the tanker, for covering said hull hole and for extending under the keel and around the bow of the tanker from the port side to the starboard side of the tanker, said sheet comprising:

i. an aft edge, for location toward the stern of the tanker and passing under the keel of the tanker, said aft edge comprising a first end and a second end;

ii. an upper portion for location substantially above the water line of the tanker, said upper portion extending substantially from the first end of the aft edge to the second end of the aft edge;

iii. an inner surface for placement substantially adjacent the hull of the tanker; and, iv. an outer surface for placement away from the hull of the tanker;

b. an aft belt, attached to the sheet substantially adjacent the aft edge of the sheet, said aft belt extending substantially from the first end of the aft edge to the second end of the aft edge, said aft belt comprising:

i. a longitudinal reinforcing strap attached to the sheet; and, ii. a first longitudinal high pressure hose for inflation, located substantially parallel to the longitudinal reinforcing strap, and attached to the longitudinal reinforcing strap on the inner surface of the sheet;

c. an upper belt, attached to the upper portion of the sheet, comprising:

i. a transverse reinforcing strap attached to the sheet, and ii. a transverse inflatable bladder attached to the upper belt on the inner surface of the sheet for inflation to substantially seal the upper portion of the sheet to the hull; and d. means for securing the hull hole closure to the tanker.

14. The hull hole closure as recited in claim 13, wherein said aft belt further comprises:

a. a second longitudinal high pressure hose for inflation, spaced apart from the first longitudinal high pressure hose, located substantially parallel to the longitudinal reinforcing strap, and attached to the longitudinal reinforcing strap on the inner surface of the sheet; and b. a first longitudinal inflatable bladder attached to the longitudinal reinforcing strap and located between the first and second high pressure hoses, for inflation to substantially seal the aft edge of the sheet to the hull.

15. The hull hole closure as recited in claim 14, wherein said aft belt further comprises securing means for securing the first longitudinal inflatable bladder in a compacted position while said first longitudinal inflatable bladder is uninflated.

16. The hull hole closure as recited in claim 15, wherein said securing means comprises a first flap and a second flap positioned for entrapment of the first longitudinal inflatable bladder in a compacted position, and means for securing the first flap to the second flap in a manner which entraps the first longitudinal inflatable bladder in said compacted position.

17. The hull hole closure as recited in claim 16, wherein the means for securing the first flap to the second flap is a length of tape.

18. The hull hole closure as recited in claim 16, wherein the means for securing the first flap to the second flap is a cable sewing the first flap to the second flap, said cable being adapted for removal prior to inflation of the first longitudinal inflatable bladder.

19. The hull hole closure as resulted in claim 14, wherein said aft belt further comprises:

a. a third longitudinal high pressure hose for inflation, spaced apart from the second longitudinal high pressure hose, remote from the first longitudinal high pressure hose, located substantially parallel to the longitudinal reinforcing strap, and attached to the longitudinal reinforcing strap on the inner surface of the sheet;

b. a second longitudinal inflatable bladder attached to the longitudinal reinforcing strap and located between the second and third high pressure hoses, for inflation to substantially seal the aft edge of the sheet to the hull; and, c. first and second securing means for respectively securing the first and second longitudinal inflatable bladders in a compacted position while said first and second longitudinal inflatable bladders are uninflated, said first and second securing means each respectively comprising:

i. a first flap and a second flap positioned for entrapment of each said respective longitudinal inflatable bladder in a compacted position, and ii. means for securing the first flap to the second flap in a manner which entraps each said respective longitudinal inflatable bladder in said compacted position.

20. The hull hole closure as recited in claim 19, wherein the means for securing the first flap to the second flap is a length of tape.

21. The hull hole closure as recited in claim 19, wherein the means for securing the first flap to the second flap is a cable sewing the first flap to the second flap, said cable being adapted for removal prior to inflation of each said respective longitudinal inflatable bladder.

22. The hull hole closure as recited in claim 13, wherein the hull hole closure additionally comprises a weight attached to the hull hole closure for spacing the hull hole closure from the hull during installation of the hull hole closure.

23. In combination with a oil tanker having a hull hole, a hull hole closure comprising:

a. a flexible, substantially waterproof sheet, shaped substantially similar to the bow of the tanker, covering said hull hole and extending under the keel and around the bow of the tanker from the port side to the starboard side of the tanker, said sheet comprising:

i. an aft edge, located toward the stern of the tanker and passing under the keel of the tanker, said aft edge comprising a first end and a second end;

ii. an upper portion located substantially above the water line of the tanker, said upper portion extending substantially from the first end of the aft edge of the second end of the aft edge;

iii. an inner surface substantially adjacent the hull of the tanker; and iv. an outer surface away from the hull of the tanker;

b. an aft belt, attached to the sheet substantially adjacent the aft edge of the sheet, said aft belt extending substantially from the first end of the aft edge to the second end of the aft edge, said aft belt comprising:

i. a longitudinal reinforcing strap attached to the sheet; and ii. a first longitudinal high pressure hose for inflation, located substantially parallel to the longitudinal reinforcing strap, and attached to the longitudinal reinforcing strap on the inner surface of the sheet;

c. an upper belt, attached to the upper portion of the sheet, comprising:

i. a transverse reinforcing strap attached to the sheet, and ii. a transverse inflatable bladder attached to the upper belt on the inner surface of the sheet for inflation to substantially seal the upper portion of the sheet to the hull; and, d. means for securing the hull closure to the tanker.

* * * * *